United States Patent [19]

Hoshino

[11] 4,301,663

[45] Nov. 24, 1981

[54] REFRIGERATING CABINET

[75] Inventor: Akitika Hoshino, Kawasaki, Japan

[73] Assignee: The General Corporation, Japan

[21] Appl. No.: 107,540

[22] Filed: Dec. 27, 1979

[30] Foreign Application Priority Data

Dec. 28, 1978 [JP] Japan ..... 53-179207[U]

[51] Int. Cl.[3] ..... F25D 19/00

[52] U.S. Cl. ..... 62/453

[58] Field of Search ..... 62/255, 256, 248, 277, 62/453

[56] References Cited

U.S. PATENT DOCUMENTS

| | | | |
|---|---|---|---|
| 2,484,310 | 10/1949 | Philipp | 62/453 |
| 2,509,611 | 5/1950 | Philipp | 62/453 X |
| 2,509,612 | 5/1950 | Philipp | 62/453 X |
| 2,654,231 | 10/1953 | Eichhorn | 62/453 X |
| 2,773,362 | 12/1956 | Scheitlin | 62/453 X |

FOREIGN PATENT DOCUMENTS

| | | | |
|---|---|---|---|
| 905977 | 9/1962 | United Kingdom | 62/453 |

*Primary Examiner*—Lloyd L. King

*Attorney, Agent, or Firm*—Robert E. Burns; Emmanuel J. Lobato; Bruce L. Adams

[57] ABSTRACT

A refrigerating cabinet comprises a metallic external casing including a front wall, a rear wall, a left- and a right-hand sidewall, a top wall and a bottom wall with an opening formed in the front wall, an internal casing fitted into the external casing and having a plurality of walls which are disposed in opposing relationship with the individual walls of the external casing with suitable clearances therebetween, a pack of a heat insulating material filling the space created between the external and the internal casing, and a condenser tube for cooling down a refrigerant from a compressor before it is fed to pressure reduction means. The condenser tube extends from the compressor to the pressure reduction means by passing through the space between the external and the internal casing, and is disposed along the inside of selected corners each defined by adjoining two walls of the external casing.

6 Claims, 6 Drawing Figures

REFRIGERATING CABINET

FIELD OF THE INVENTION

The invention relates to a refrigerating cabinet, and more particularly, to an arrangement of a condenser tube in a refrigerator of a refrigerating cabinet.

In the refrigerator of a refrigerating cabinet, a refrigerant is converted into an overhead, high pressure gas by means of a compressor and fed into a condenser where it is cooled down and liquidified. Subsequently, the pressure is reduced in a capillary tube to be supplied to an evaporator which is located within the cabinet. The condenser normally comprises a sufficient length of tube which is required for the cooling and liquefaction of the overheated gas. This condenser tube is disposed in a serpentine form with a suitable spacing between adjacent lengths on the outside of the rear plate of an external casing for the cabinet, and thus remains exposed to the atmosphere. When the condenser tube is exposed to the exterior, it is necessary to provide a suitable clearance between the condenser tube and the wall surface of a room in which the cabinet is located in order to dissipate heat produced by the tube. This disadvantageously increases the area or the space required for the installation of a refrigerating cabinet. In addition, the condenser tube may be subject to a breakage or a bending during the time the cabinet is being shipped or installed.

DESCRIPTION OF THE PRIOR ART

In order to overcome the described disadvantages, U.S. Pat. No. 2,484,310 issued Oct. 11, 1949 to Lawrence A. Philipp discloses a refrigerating cabinet having a double-walled box including an external and an internal casing wherein a condenser tube is disposed inside and in contact with the rear plate of the external casing in order to dissipate the heat from the tube to the external atmosphere through the rear plate. This eliminates the condenser tube from the back of the refrigerating cabinet, reducing the space required for its provision at least by an amount corresponding to the clearance which has been heretofore required between the condenser tube and the rear plate, and also preventing any likelihood of damage to the tube. However, because the condenser tube is disposed in the region of the rear plate in a concentrated manner with this construction, it is possible that part of the heat produced by the tube may leak to the internal casing through a heat insulating material. To accommodate for this, there must be provided an increased spacing between the rear plate of the external casing and its facing well, namely, the wall of the internal casing, and also the thickness of the layer of heat insulating material must be increased. As a result, when compared with a refrigerating cabinet of the type in which the condenser tube is externally exposed and which has the same volume, the refrigerating cabinet disclosed in the patent has a reduced internal volume. In addition, because the condenser tube must be tightly held against the rear plate, special retaining means is required, which prevents a difficulty in the assembly of the casing.

SUMMARY OF THE INVENTION

It is an object of the invention to provide a refrigerating cabinet having a double-walled box formed by an external and an internal casing and in which a major portion of a condenser tube having an increased length is disposed so that the heat from the tube may be dissipated by diffusion to the exterior through the external casing.

It is another object of the invention to provide a refrigerating cabinet of the type described in which the condenser tube can be held in place by retainers which are simply formed by folding part of the external casing, without requiring the use of a special retaining means.

In accordance with the invention there is provided a refrigerating cabinet comprising a metallic external casing including a front wall, a rear wall, a left- and a right-hand sidewall, a top wall and a bottom wall with an opening formed in the front wall, an internal casing fitted into the external casing and having a plurality of walls which are disposed in opposing relationship with the rear wall, the left- and the right-hand sidewall, the top wall and the bottom wall of the external casing with suitable clearances therebetween, a pack of a heat insulating material filling the space created between the external and the internal casing, a compressor disposed on the outside of the external casing, an evaporator disposed within the internal casing, and a condenser unit including a condenser tube for cooling down and reducing the pressure of a refrigerant from the compressor before it is fed to the evaporator, the condenser tube extending from the compressor to the evaporator bypassing a space created between the external and the internal casing, the condenser tube passing through the space along the inside of a plurality of corners defined by selected adjoining walls of the external casing.

In the refrigerating cabinet according to the invention, a condenser tube extends from a compressor initially along the inside of a corner defined by the rear plate and the bottomplate of an external casing and then along the inside of another corner defined by one of sideplates of the external casing and the bottomplate so as to reach the front face of the external casing. From the front face of the external casing, the condenser tube extends upwardly along the inside of a corner defined by the front face of the external casing and said one sideplate and then extends to the other sideplate along the inside of a corner formed by the top plate of the external casing and the front face. The condenser tube then extends from the other sideplate downwardly along the inside of a corner defined by the front face and the other sideplate until the bottomplate is reached where it then extends toward the rear plate along the inside of a corner defined by the bottomplate and the other sideplate. After extending along corners defined by the rear plate, the sideplates and the top plate, the condenser tube is connected with an evaporator. Vertical runs of the condenser tube are firmly held by condenser retainers which are formed integrally with the opposite ends of the sideplates by a simple folding operation, so that the heat from the condenser tube can be transmitted through the retainers to the sideplates and then to the external atmosphere. By disposing the condenser tube within the external casing, the rear surface of the refrigerating cabinet remains flat, reducing the space are area required for its installation. Since the condenser tube extends along the corners of the external casing which are located remote from the internal casing, and since it is not disposed on a concentrated manner on one surface thereof, the heat transfer from the condenser tube to the internal casing can be reduced to a negligibly small value.

DESCRIPTION OF PREFERRED EMBODIMENTS

Figure 1:
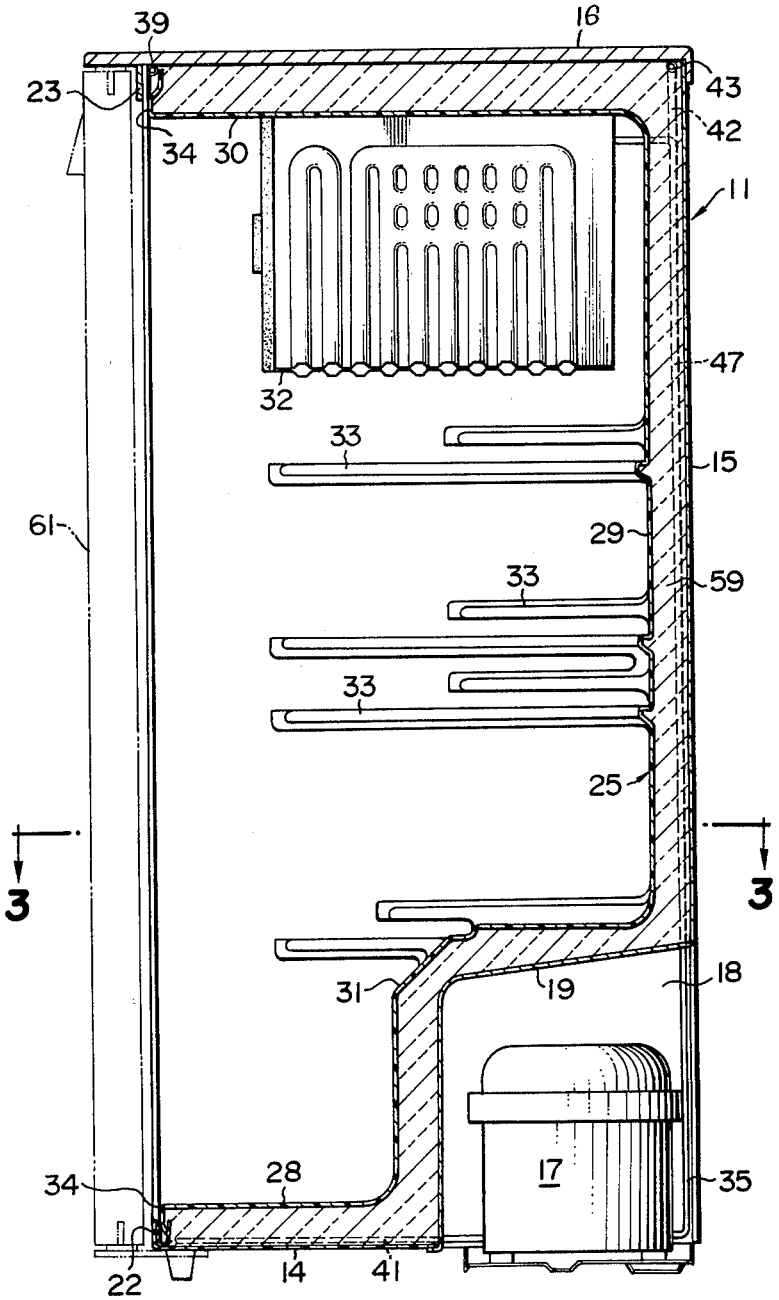
FIG. 1 is a longitudinal section of a refrigerating cabinet according to one embodiment of the invention.
Figure 2:
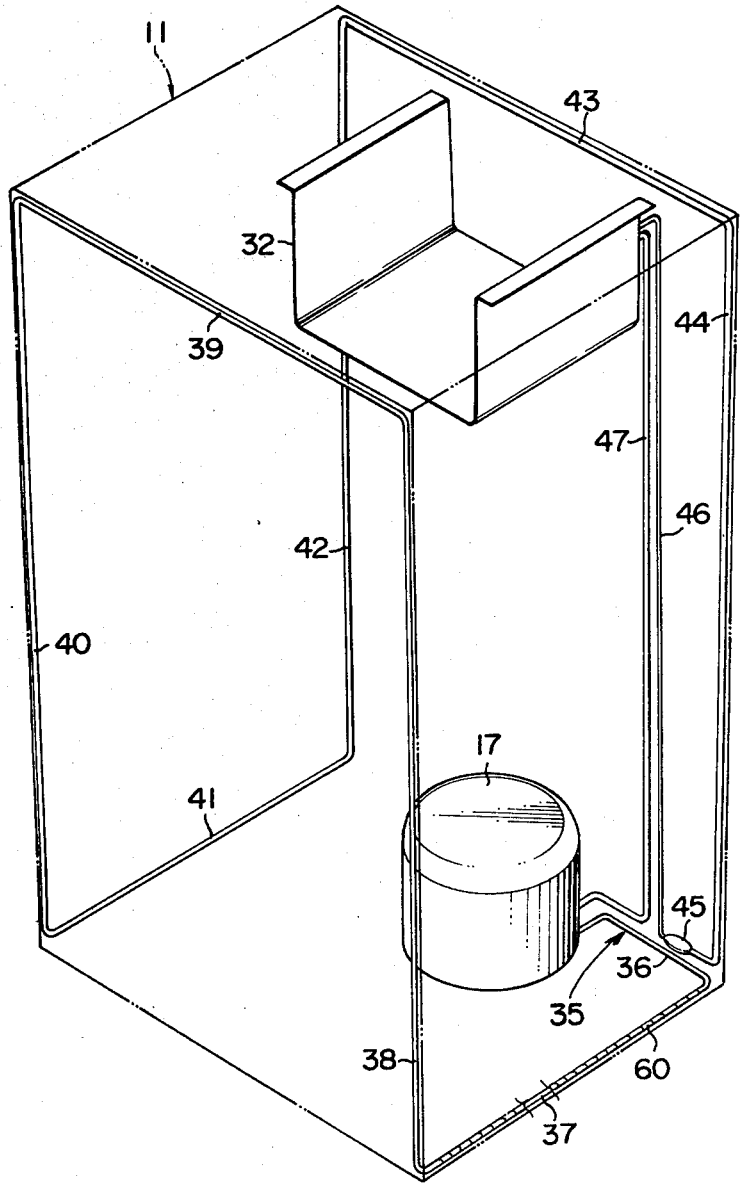
FIG. 2 is a perspective view of the cabinet, illustrating the disposition of the condenser tube.
Figure 3:
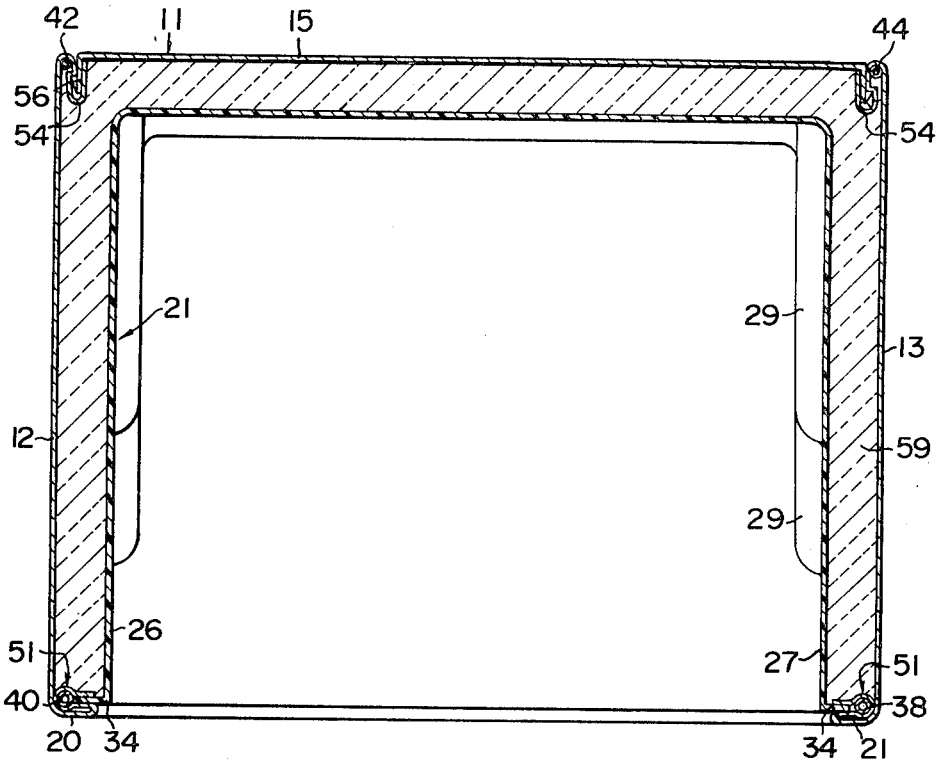
FIG. 3 is a transverse section taken along the line 3—3 shown in FIG. 1.

Referring to FIGS. 1 to 5, there is shown one embodiment of the invention. The refrigerating cabinet of this embodiment includes a metallic external casing which is generally indicated by a reference numeral 11. The external casing includes a left- and a right-hand sideplate 12, 13, a bottomplate 14, a rear plate 15 and a top plate 16. It should be noted that the front side of the external casing, namely, the left-hand side as viewed in FIG. 1 or the lower side as viewed in FIG. 3, is open. A partitioning plate 19 is disposed in the lower corner of the external casing which is defined by the sideplates 12, 13, the bottomplate 14 and the rear plate 15 in order to define a machine room 18 in which a compressor 17 or the like is contained. The front ends of sideplates 12, 13 are formed with front flanges 20, 21 which are folded at right angles to the respective sideplates. The front end of the bottomplate 14 is also formed with an upright, front flange 22 which is also bent at right angles to the bottomplate. A strip-shaped upper front flanges 23 extends across the upper ends of the front flanges 20, 21. An internal casing 25 which has an open front side is fitted into the external casing 11. The internal casing 25 includes a left- and a right-hand sideplate 26, 27, a bottomplate 28, a rear plate 29, a top plate 30 and a stepped plate 31, all of which are formed of a metal or synthetic resin material and which are disposed at suitable spacings from the sideplates 12, 13, the bottomplate 14, the rear plate 15, the top plate 16 and the partitioning plate 19 of the external casing 11, respectively. An evaporator 32 is mounted on the underside of the top plate 30 of the internal casing 25. The left- and right-hand sideplate 26, 27 and the rear plate 29 are integrally formed with a plurality of ledges 33 which are used in fixing shelf plates (not shown) thereon. Around its full periphery, the front edge of the internal casing 25 which defines its front opening is folded outwardly at right angles so as to be aligned with the individual flanges 20, 21, 22 and 23 of the external casing 11, thus defining a front flange 34 of the refrigerating cabinet.

As shown in detail in FIG. 2, a condenser tube 35 is disposed between the external and the internal casing 11, 21 so as to extend along the inside of the corners of the external casing 11. The purpose of the condenser tube is to cool down a refrigerant such as ammonia or freon gas which is compressed by the compressor 17 into an overheated, high pressure gas. Specifically, one end of the condenser tube 35 is connected to the compressor 17. It includes a plurality of runs including a first run 36 extending to the right (as viewed in FIG. 2) along the inside of a corner defined by the bottomplate 14 and the rear plate 15, a second run 37 extending forwardly along the inside of a corner defined by the right-hand sideplate 13 and the bottomplate 14 and contiguous with the first run 36, a third run 38 contiguous with the second run and extending upwardly along the inside of a corner defined by the right-hand sideplate 13 and the front flange 21, a fourth run 39 contiguous with the third run and extending to the left along the inside of a corner defined by the top plate 16 and the upper front flange 23, a fifth run 40 contiguous with the fourth run and extending downwardly along the inside of a corner defined by the left-hand sideplate 12 and the front flange 20, a sixth run 41 contiguous with the fifth run and extending rearwardly along the inside of a corner defined by the left-hand sideplate 12 and the bottomplate 14, a seventh run 42 contiguous with the sixth run 41 and extending upwardly along the inside of a corner defined by the left-hand sideplate 12 and the rear plate 15, and an eighth run 43 contiguous with the seventh run and extending to the right along the inside of a corner defined by the rear plate 15 and the top plate 16 and a ninth run 44 contiguous with the eighth run 43 and extending downwardly along the inside of a corner defined by the right-hand sideplate 13 and the rear plate 15. The other end of the ninth run 44 is connected to a capillary tube 46 which serves reducing the pressure through a strainer 45. After its pressure is reduced by the capillary tube 46, the refrigerant is fed to the evaporator 32. The evaporator supplies the refrigerant through a piping 47 to the compressor 17 where it is compressed and fed into the condenser tube 35 again.

Figure 4:
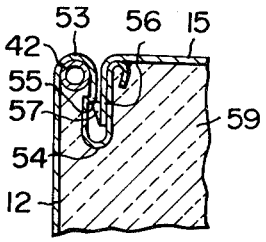
FIG. 4 is an enlarged cross section of a junction between the sideplate and the rear plate.
Figure 5:
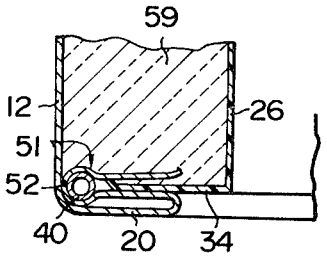
FIG. 5 is an enlarged cross section of a junction defined by the front face of the external casing and the front face of the internal casing.

Referring to FIGS. 1 and 3 to 5, the assembly of the external and the internal casing 11, 25 and the manner of fixing the condenser tube 35 in place will now be described. Referring to FIG. 5, it will be noted that the left-hand front flange 22 of the external casing 11 has its end folded back inwardly and then again folded back outwardly to define a retainer 51 which is substantially U-shaped in horizontal section. The retainer 51 has a bottom 52 which receives the fifth run 40 of the condenser tube 35 in tight engagement therewith. It is to be noted that the spacing between the oppositely located limbs of the U-shaped retainer 51 is less than the thickness of the flange 34 of the internal casing 25, so that when the flange 34 is inserted into the clearance therebetween, it is a tight fit therein. The right-hand front flange 21 of the external casing 11 is similarly formed with another retainer 51 having a bottom 52 which receives the third run 38 of the condenser tube 35 in tight engagement therewith. The flange 34 on the right-hand side 27 of the internal casing 25 is inserted into the oppositely located limbs of the retainer. Referring to FIG. 4, the left-hand sideplate 12 of the external casing 11 has its rear end initially folded inwardly with an internal diameter substantially corresponding to the outer diameter of the condenser tube 35 to define a condenser retainer 53 in which to hold the seventh run 42 therein, and then folded back outwardly to define a rear plate retainer 54 which is substantially U-shaped in horizontal section. It is to be noted that the rear plate retainer 54 is formed with a step 55 therein which extends toward the condenser tube 35 and hence has an increased width in the deep end thereof than in the entrance thereof. The right-hand sideplate 13 of the external casing 11 is similarly formed with a condenser retainer 53, a rear plate retainer 54 and a step 55. The condenser retainer 53 holds the ninth run 44 of the condenser tube 35 in tight engagement therewith.

Along its opposite lateral sides, the rear plate 15 is formed with folded pieces 56 which are inserted into the left- and right-hand rear plate retainers 54, with a barb 57 formed on each folded piece 56 to engage the step 55 to prevent an unintended withdrawal of the rear plate 15 from the retainers 54. It will be appreciated that the opposite ends of the lower front flange 22 formed on the bottomplate 14 of the external casing 11 are similarly formed with inwardly extending retainers 58 which are substantially U-shaped in vertical section to receiver the flange 34 on the bottomplate 28 of the internal casing 25 therein. When the external and the internal casings 11, 25 are assembled together in this manner, a foamed, heat insulating material 59 such as liquid urethane may be injected into the clearance between the both casings to define a heat insulating layer.

It will be understood from the foregoing description that the third, the fifth, the seventh and the ninth runs 38, 40, 42 and 44 of the condenser tube 35 are firmly held in tight engagement with the external casing 11 by the retainers 51, 53 which are formed integrally with the sideplates 11, 12. Consequently, the heat from the refrigerant produced in these regions 38, 40, 42, 44 of the condenser tube 35 can be transferred to the entire external casing 11 through these retainers and then dissipated to the external atmosphere. It is to be noted that the second, the fourth, the sixth and the eighth runs 37, 39, 41 and 43 of the condenser tube 35 communicate with the third, the fifth, the seventh and the ninth runs 38, 40, 42 and 44, respectively, through notches (not shown) formed in the upper and lower ends of the respective condenser tube retainers. It will also be noted that the first, the second, the fourth, the sixth and the eighth runs 36, 37, 39, 41 and 43 of the condenser tube 35 are not positively carried by the retainers as mentioned above while partly contacting the external casing 11. However, it is recognized that the contact between the condenser tube 35 and the external casing is sufficient to provide a heat dissipating effect. Nevertheless, it is possible to provide a wrapping of a heat insulating tape around these regions, as indicated at 60 for the second run 37 in FIG. 2, to prevent a flow of heat from these regions to the internal casing 25.

When the condenser tube 35 is disposed to extend along the individual corners of the external casing 11 as mentioned above, the spacing between the condenser tube 35 and the internal casing 25 can be increased, thus presenting an increased resistance to the flow of heat from the condenser tube 35 to the internal casing 25. As compared with the provisions of a serpentine condenser tube on the back side of the rear plate of the external casing, the thickness of the heat insulating material can be reduced. It is to be noted that when the refrigerant from the compressor 17 which is heated to a relatively high temperature is initially fed to the front side of the external casing 11 as in the present embodiment, such heat can be efficiently utilized to prevent condensation of moisture adjacent a door 61 which is indicated in phantom line in FIG. 1.

Figure 6:
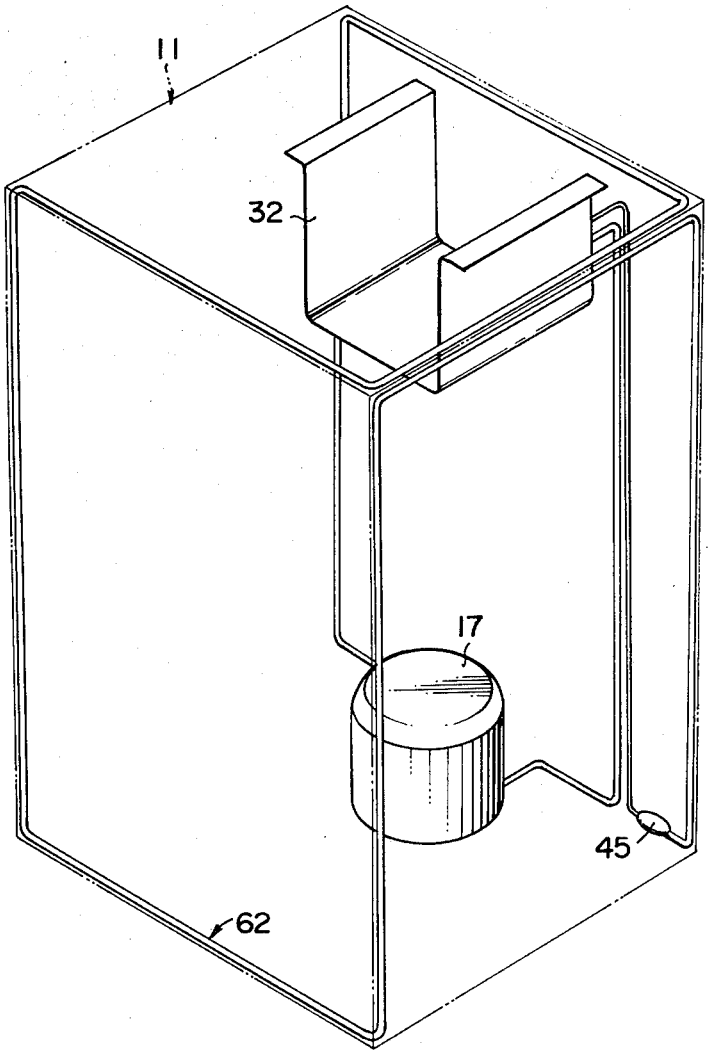
FIG. 6 is a perspective view showing another disposition of the condenser tube.

FIG. 6 shows a modification of the described arrangement which permits the length of the condenser tube to be increased. In this instance, a condenser tube 62 from the compressor 17 extends to and along the inside of a corner defined by one of the sideplates and the rear plate, then along the inside of a corner defined by the top plate and the rear plate, along the inside of another corner defined by the top plate and the other sideplate until it reaches the front side of the external casing where it passes along the inside of all of four corners formed on the front side of the external casing. The condenser tube 62 then extends along the inside of a corner defined by the top plate and the other sideplate, and along the inside of a corner defined by the rear plate and the other sideplate for connection with a strainer 45. It will be noted that the resulting arrangement is greater in length than the piping system of FIG. 2 by a length which corresponds to one side of the front of the external casing, thus enhancing the cooling effect upon the refrigerant passing through the condenser tube. In this embodiment, the condenser tube extends along the inside of the corner defined by the top plate and the other sideplate once in one direction and another time in the opposite direction. However, a local heating of this corner cannot occur since the refrigerant is considerably cooled down after it has passed along the four front corners of the external casing.

What is claimed is:

1. A refrigerating cabinet comprising: a metallic external casing including a front wall, a rear wall, a left- and a right-hand sidewall, a top wall and a bottom wall with an opening formed in the front wall; an internal casing fitted into the external casing and having a plurality of walls which are disposed in opposing relationship with the rear wall, the left- and the right-hand sidewall, the top wall and the bottom wall of the external casing with suitable clearances therebetween; heat-insulating material disposed in the clearance space between the external and the internal casings; a compressor disposed on the outside of the external casing; an evaporator disposed within the internal casing; and a condenser unit including a condenser tube for cooling down and reducing the pressure of a refrigerant from the compressor before it is fed to the evaporator, the condenser tube extending along the inside of at least three of the four corners defined by the front wall and the adjoining sidewalls, the top wall and the bottom wall of the external casing and also extending along the inside of at least three of the four corners defined by the rear wall and the adjoining sidewalls, the top wall and the bottom wall of the external casing.

2. A refrigerating cabinet according to claim 1 in which the front and rear ends of the respective sideplates of the external casing are integrally formed with condenser retainers which hold the condenser tube therein.

3. A refrigerating cabinet according to claim 1 in which the condenser tube extends continuously without interruption along the inside of said at least three of the four corners of the external casing.

4. A refrigerating cabinet according to claim 1 in which the condenser tube comprises straight runs extending along the inside of said at least three of the four corners of the external casing defined by at least one of the front and rear walls.

5. A refrigerating cabinet according to claim 1 in which the condenser tube comprises straight runs extending along the inside of said at least three of the four corners of the external casing defined by both the front and rear walls.

6. A refrigerating cabinet according to any one of claims 1, 2, 3, 4 and 5 in which the condenser tube is configured to extend along the inside of the four corners of the external casing defined by at least one of the front and rear walls.

* * * * *